US005811765A

United States Patent [19]

Nakagawa et al.

[11] Patent Number: 5,811,765

[45] Date of Patent: Sep. 22, 1998

[54] HEATING APPLIANCE HAVING NEGATIVE POTENTIAL TREATMENT FUNCTION

[75] Inventors: Takeshi Nakagawa, Takatsuki; Kosaku Mitani, Kaizuka, both of Japan

[73] Assignee: Osaka Nishikawa Co., Ltd., Osaka-fu, Japan

[21] Appl. No.: 779,953

[22] Filed: Dec. 23, 1996

[30] Foreign Application Priority Data

| | | | |
|---|---|---|---|
| Dec. 28, 1995 | [JP] | Japan | 7-343143 |
| Dec. 28, 1995 | [JP] | Japan | 7-343144 |
| Dec. 28, 1995 | [JP] | Japan | 7-343145 |

[51] Int. Cl.[6] ..... H05B 1/02

[52] U.S. Cl. ..... 219/497; 219/481; 219/212; 219/505; 307/91; 361/220

[58] Field of Search ..... 219/212, 528, 219/481, 501, 505, 504, 508; 307/91, 326; 361/212, 220

[56] References Cited

U.S. PATENT DOCUMENTS

| | | | |
|---|---|---|---|
| 4,931,625 | 6/1990 | Marlinski | 219/528 |
| 4,998,006 | 3/1991 | Perlman | 219/212 |
| 5,081,341 | 1/1992 | Rowe | 219/505 |
| 5,173,587 | 12/1992 | Nakano et al. | 219/212 |
| 5,206,485 | 4/1993 | Srubas et al. | 219/549 |
| 5,465,013 | 11/1995 | Bassen et al. | 307/91 |

FOREIGN PATENT DOCUMENTS

| | | |
|---|---|---|
| 62-74373 | 4/1987 | Japan . |
| 3-191967 | 8/1991 | Japan . |

*Primary Examiner*—Mark H. Paschall
*Attorney, Agent, or Firm*—Armstrong, Westerman, Hattori, McLeland & Naughton

[57] ABSTRACT

A heater includes a first heat-generating conductor, a second heat-generating conductor and a shield conductor. The first heat-generating conductor and the second heat-generating conductor are integrally covered with the shield conductor. One end of the first heat-generating conductor and one end of the second heat-generating conductor are electrically connected to each other. When a current is applied from the other end of the first heat-generating conductor, the current flows in the first heat-generating conductor and the second heat-generating conductor in opposite directions. A negative potential −Vn is applied to the shield conductor from a negative potential generating circuit. A positive potential terminal connecting circuit is composed of two diodes. One of the diodes has its anode connected to the positive potential terminal of the negative potential generating circuit and its cathode connected to a first line. The other diode has its anode connected to the positive potential terminal and its cathode connected to a second line. The negative potential terminal of the negative potential generating circuit is connected to the shield conductor of the heater and a shield conductor of a temperature sensor.

19 Claims, 10 Drawing Sheets

HEATING APPLIANCE HAVING NEGATIVE POTENTIAL TREATMENT FUNCTION

BACKGROUND OF THE INVENTION

1. Field of the Invention

The present invention relates to heating appliances, and particularly to a heating appliance having a negative potential (minus potential) treatment function.

2. Description of the Background Art

Conventionally, various heating appliances for warming human bodies have been developed, such as electric blankets, electric rugs, foot heaters, etc. Furthermore, since a negative potential has the effect of healing stiff shoulders etc., heating appliances having a negative potential treatment function have also been developed, as disclosed in Japanese Patent Laying-Open No.62-74373 and Japanese Patent Laying-Open No.3-191967, for example.

In such a heating appliance, a high-level negative potential is generated from a negative potential terminal of a negative potential generating circuit with its positive potential terminal held at the ground potential, which is applied to an electrode (an electrical heating wire mat) included in the body of the heating appliance.

Resistor of the heater is usually used both as a heating element and as an electrical heating wire mat for providing negative potential. Accordingly, the heater composed of the resistor is connected to an AC power supply in half-cycles of an alternating voltage to cause the heater to generate heat. In the other half-cycles of the alternating voltage, the heater is cut off from the AC power supply and supplied with the negative high voltage from the negative potential generating circuit.

FIG. 10 is a circuit diagram showing an example of a conventional heating appliance. In FIG. 10, one electrode n1 of an outlet (a connecting outlet for supplying electric power) 300 is connected to a grounded potential line (inactive line) 301 of an AC power supply (a source for supplying commercial power) AC and its other electrode n2 is connected to an ungrounded potential line (active line) 302 of the AC power supply AC. One electrode of the plug (a connector for taking power in) 51 is connected to a line L1 and its other electrode is connected to a line L2. A DC power-supply circuit 54 for generating a certain direct voltage is connected to the lines L1 and L2 through a transformer 53.

When the plug 51 is inserted into the outlet 300 and the main switch 52 is turned on, an alternating voltage is applied between the lines L1 and L2. Then a delay circuit 55 keeps the contacts of a relay 56 off for a certain period. In this period, an earth line detecting circuit 58 detects whether the line L2 is connected to the grounded potential line 301 of the AC power supply AC.

For example, if the line L2 is connected to the ungrounded potential line 302, a current $I_0$ flows to the line L2 from a capacitance C interposed between ground G and the heating appliance body through the line L4 and the resistance R. This causes the earth line detecting circuit 58 to connect the contacts of the relay 57 to the terminals b. On the other hand, if the line L2 is connected to the grounded potential line 301, the current $I_0$ does not flow through the line L4, the resistance R and the line L2. Accordingly, the earth line detecting circuit 58 connects the contacts of the relay 57 to the terminals a. Then the delay circuit 55 turns on the contacts of the relay 56. This way, the line L4 is always connected to the grounded potential line 301 of the AC power supply AC.

The negative potential generating circuit 59 has a positive potential terminal N11 connected to the line L4 and a negative potential terminal N12 connected to one end of the heater 70 through a protection resistance 60. This negative potential generating circuit 59 generates a high-level negative potential (minus potential) from the negative potential terminal N12 with its positive potential terminal N11 held at the ground potential and provides the negative potential to the one end (node N10) of the heater 70 through the protection resistance 60 in the positive half-cycles of the alternating voltage. The control circuit 61 turns on the thyristor 62 in the negative half-cycles of the alternating voltage from the AC power supply AC and turns off the thyristor 62 in the positive half-cycles of the alternating voltage.

FIG. 11 (*a*) shows the alternating voltage of the AC power supply AC, (b) shows the potential at the one end of the heater 70, and (c) shows the current flowing in the heater 70.

As shown in FIG. 11, the heater 70 is supplied with a negative potential in the positive half-cycles of the alternating voltage and it is supplied with a current in the negative half-cycles of the alternating voltage. This allows a negative potential treatment function in the positive half-cycles of the alternating voltage and allows heating in the negative half-cycles of the alternating voltage.

In the aforementioned conventional heating appliance, as shown in FIG. 11(*c*), a current flows in the heater 70 only in the negative half-cycles of the alternating voltage. Accordingly, the current intermittently flows to the heater 70. The intermittent current generates an electro-magnetic wave. The electro-magnetic wave may exert some influence on the human body because such a heating appliance is used in touch with a human body in a long time during winter. Moreover, the electro-magnetic wave may more nor less affect the surroundings because the heating appliance is used in various places.

For example, when a treatment is performed using a treatment equipment composed of precise electronic devices while heating a human body in a treatment room in a hospital, the electro-magnetic wave generated by the intermittent current may cause an electro-magnetic inductive trouble in the treatment equipment.

Furthermore, the aforementioned conventional heating appliance requires the delay circuit 55, the earth line detecting circuit 58, and the two sets of relays 56, 57 to detect whether the line L2 is connected to the grounded potential line 301 of the AC power supply AC or connected to the ungrounded potential line 302 and always connect the line L4, which is connected to the positive potential terminal N11 of the negative potential generating circuit 59, to the grounded potential line 301 of the AC power supply AC. This increases the number of parts, causing an increase in cost of the heating appliance and preventing down-sizing of the controller.

Moreover, detecting whether the line L2 is connected to the grounded potential line 301 or to the ungrounded potential line 302 according to presence/absence of current may lead to an error in detecting and connecting the grounded potential line 301.

Furthermore, in the aforementioned conventional heating appliance, the pattern of generation of the negative potential is limited because the negative potential treatment function is effected only in the half-cycles of the alternating voltage. Hence, it is difficult to achieve effective treatment depending on conditions of stiff shoulders etc.

SUMMARY OF THE INVENTION

An object of the present invention is to provide a low-priced heating appliance which achieves a negative potential treatment function while suppressing generation of electromagnetic wave (electric field wave and magnetic field wave).

Another object of the present invention is to provide a heating appliance which can automatically switch and electronically connect a positive potential terminal of a negative potential generating circuit certainly to a potential line on the ground potential or negative potential side of an AC power supply with simple structure, following the change of the voltage of the AC power supply.

Still another object of the present invention is to provide a heating appliance having a negative potential treatment function which is capable of generating a negative potential in arbitrary patterns.

A further object of the present invention is to provide a positive potential terminal connecting circuit which can electrically connect a positive potential terminal of a negative potential generating circuit to a potential line on the ground potential or the negative potential side of the AC power supply for certain with a simple structure.

A heating appliance according to the present invention includes a first conductive line and a second conductive line provided along the first conductive line, at least one of the first and second conductive lines being composed of a heating element, one end of the first conductive line and one end of the second conductive line being electrically connected to each other, and the heating appliance further includes a shield conductor integrally surrounding the first and second conductive lines, a current supplying source for supplying a current from the other end of the first conductive line to the other end of the second conductive line, and a negative potential generating circuit for providing a negative potential to the shield conductor.

In the heating appliance, one end of the first conductive line and one end of the second conductive line are electrically connected to each other. When a current is applied by the current supply source from the other end of the first conductive line to the other end of the second conductive line, the current flows in the first conductive line and the second conductive line in opposite directions. Accordingly, the magnetic field produced by the current flowing in the first conductive line and the magnetic field produced by the current flowing in the second conductive line are in opposite directions. Hence, the magnetic field caused by the current flowing in the first conductive line and the magnetic field caused by the current flowing in the second conductive line are cancelled. Thus magnetic field is scarcely produced around the first and second conductive lines.

The first and second conductive lines are integrally surrounded by the shield conductor and a negative potential is applied to the shield conductor. Hence, the electric field in the shield conductor is electrostatically shut off by the shield conductor and no electric field by the first and second conductive lines is produced outside of the shield conductor.

This way, magnetic field and electric field are hardly formed around the first and the second conductive line and almost no electro-magnetic wave is produced. Furthermore, since the negative potential is applied to the shield conductor, the shield conductor effects the negative potential treatment function.

This provides an inexpensive heating appliance which has a negative potential treatment function with suppressed generation of electro-magnetic waves.

It is preferred that the first conductive line, the second conductive line and the shield conductor are formed on a common axis. This effectively suppress generation of magnetic field and electric field. Moreover, since the first conductive line, the second conductive line and the shield conductor are integrated into a single cable, it is easy to handle.

The current supply source may include an AC power supply and a rectifying circuit for conducting a current to the first and second conductive lines only in negative half-cycles of an alternating voltage of the AC power supply. Then the potentials on the first and second conductive lines also go negative. Thus the negative potential treatment effect is improved.

The negative potential generating circuit may have a positive potential terminal and a negative potential terminal and may generate a negative potential from the negative potential terminal, and the heating appliance may further include a first unidirectional conducting function element connected between the positive potential terminal of the negative potential generating circuit and a first potential line for conducting a current in the direction from the positive potential terminal to the first potential line, a second unidirectional conducting function element connected between the positive potential terminal of the negative potential generating circuit and a second potential line for conducting a current in the direction from the positive potential terminal to the second potential line, and a connecting device for connecting the first potential line to one of a grounded potential line and an ungrounded potential line of an AC power supply and connecting the second potential line to the other of the grounded potential line and the ungrounded potential line of the AC power supply.

In this specification, the unidirectional conducting function element represents an element which has a function of conducting in one direction.

Each of the first and second unidirectional conducting function elements may be composed of a diode.

The heating appliance may further include a control circuit for controlling the generation pattern of the negative potential generated by the negative potential generating circuit. The control circuit may include a storage device for storing one or a plurality of negative potential generating patterns, a selector for selecting any of the one or plurality of negative potential generating patterns stored in the storage device, and a negative potential generating pattern control circuit for controlling the negative potential generating circuit on the basis of the negative potential generating pattern selected by the selector.

The negative potential generating pattern may include the generating timing and the generating period of the negative potential. The negative potential generating pattern may include the level of the negative potential.

A heating appliance according to another aspect of the present invention includes a negative potential generating circuit, an electrode, a first unidirectional conducting function element, a second unidirectional conducting function element and a connecting device. The negative potential generating circuit has a positive potential terminal and a negative potential terminal and generates a negative potential from the negative potential terminal. The electrode is supplied with the negative potential generated from the negative potential generating circuit. The first unidirectional conducting function element is connected between the positive potential terminal of the negative potential generating circuit and a first potential line to conduct a current in the direction from the positive potential terminal to the first potential line. The second unidirectional conducting function element is connected between the positive potential terminal of the negative potential generating circuit and a second potential line to conduct a current in the direction from the positive potential terminal to the second potential line. The connecting device connects the first potential line to one of a grounded potential line and an ungrounded potential line of an AC power supply and connects the second potential line to the other of the grounded potential line and the ungrounded potential line of the AC power supply.

In the heating appliance, when the first potential line is connected to the grounded potential line of the AC power supply and the second potential line is connected to the ungrounded potential line of the AC power supply, the potential on the first potential line is held at the ground potential. In the positive half-cycles of the alternating voltage of the AC power supply, the potential on the second potential line goes positive. Then the first unidirectional conducting function element turns on and the second unidirectional conducting function element turns off, and the potential at the positive potential terminal of the negative potential generating circuit almost reaches the ground potential. In the negative half-cycles of the alternating voltage of the AC power supply, the potential on the second potential line goes negative. Then the first unidirectional conducting function element turns off and the second unidirectional conducting function element turns on, and the potential at the positive potential terminal of the negative potential generating circuit goes negative.

On the other hand, when the first potential line is connected to the ungrounded potential line of the AC power supply and the second potential line is connected to the grounded potential line of the AC power supply, the potential on the second potential line is held at the ground potential. In the positive half-cycles of the alternating voltage of the AC power supply, the potential on the first potential line goes positive. Then the first unidirectional conducting function element turns off and the second unidirectional conducting function element turns on, and the potential at the positive potential terminal of the negative potential generating circuit almost becomes ground potential. In the negative half-cycles of the alternating voltage of the AC power supply, the potential on the first potential line goes negative. Then the first unidirectional conducting function element turns on and the second unidirectional conducting function element turns off, and the potential at the positive potential terminal of the negative potential generating circuit goes negative.

This way, regardless of whether the first and second potential lines are connected to either of the grounded potential line and the ungrounded potential line of the AC power supply, the first and second unidirectional conducting function elements electronically detect a potential line on the ground potential or negative potential side and the positive potential terminal of the negative potential generating circuit is automatically connected to the potential line on the ground potential or negative potential side. In this case, detecting and connecting the ground potential or the negative potential side potential line by means of on/off of the first and second unidirectional conducting function elements eliminates the possibility of erroneous detection and erroneous connection.

Accordingly, it is possible to automatically connect the positive potential terminal of the negative potential generating circuit certainly to the ground potential or the negative potential side potential line of the AC power supply with simple structure. As a result, a low-priced heating appliance is realized which effectively produces the negative potential treatment function.

Each of the first and second unidirectional conducting function elements may be composed of a diode. In this case, a potential line on the ground potential or negative potential side is electronically detected by the two diodes and the positive potential terminal of the negative potential generating circuit is automatically connected to the potential line on the ground potential or negative potential side. This further simplifies the structure of the controller of the heating appliance, allowing a reduction in size of the controller.

A heating appliance according to still another aspect of the present invention includes a heating element, a current supply source for supplying a current to the heating element, a negative potential generating circuit for generating a negative potential, an electrode provided separately from the heating element and supplied with the negative potential generated by the negative potential generating circuit, and a control circuit for controlling generating pattern of the negative potential generated by the negative potential generating circuit.

In that heating appliance, a current is supplied from the current supply source to the heating element and a negative potential is provided to the electrode from the negative potential generating circuit. As the electrode is provided separately from the heating element, it is possible to arbitrarily control the generating pattern of the negative potential with the control circuit. Hence, it is possible to effectively apply the negative potential treatment function depending on conditions.

The control circuit may include a storage device for storing one or a plurality of negative potential generating patterns, a selector for selecting any of the one or plurality of negative potential generating patterns stored in the storage device, and a negative potential generating pattern control circuit for controlling the negative potential generating circuit on the basis of the negative potential generating pattern selected by the selector.

In that heating appliance, the storage device stores one or a plurality of negative potential generating patterns in advance, which allows a user to select a desired negative potential generating pattern with the selector to easily achieve suitable negative potential treatment depending on the condition.

The negative potential generating pattern may include the negative potential generating timing and period. In this case, the timing of the negative potential generated by the negative potential generating circuit and its generating periods can be arbitrarily changed.

The negative potential generating pattern may include the level of the negative potential. In this case, the level of the negative potential generated by the negative potential generating circuit can be arbitrarily changed.

The heating element may be formed of a heat generating line and the electrode supplied with the negative potential may be composed of a shield conductor surrounding the heat generating line. Then the heating element and the electrode having both the function of shielding electric field caused by the electric power supplied to the heating element and the function of supplying the negative potential can be constructed in a compact size, being easy to handle.

A positive potential terminal connecting circuit according to still another aspect of the present invention is directed to a positive potential terminal connecting circuit for electrically connecting a positive potential terminal of a negative potential generating circuit to a potential line on a ground potential or a negative potential side of an AC power supply, which includes a first unidirectional conducting function element and a second unidirectional conducting function element.

The first unidirectional conducting function element is connected between a first potential line connected to one of the grounded potential line and the ungrounded potential line of the AC power supply and the positive potential terminal of the negative potential generating circuit and conducts a current in the direction from the positive potential terminal to the first potential line. The second unidirectional conducting function element is connected between a second potential line connected to the other of the grounded potential line and the ungrounded potential line of the AC power supply and the positive potential terminal of the negative potential generating circuit to conduct a current in the direction from the positive potential terminal to the second potential line.

In the positive potential terminal connecting circuit, when the first potential line is connected to the grounded potential line of the AC power supply and the second potential line is connected to the ungrounded potential line of the AC power supply, the first potential line is held at the ground potential. In the positive half-cycles of the alternating voltage of the AC power supply, the potential on the second potential line goes positive. Then the first unidirectional conducting function element turns on and the second unidirectional conducting function element turns off, and the potential at the positive potential terminal of the negative potential generating circuit almost reaches the ground potential. In the negative half-cycles of the alternating voltage of the AC power supply, the potential on the second potential line goes negative. Then the first unidirectional conducting function element turns off and the second unidirectional conducting function element turns on, and the potential at the positive potential terminal of the negative potential generating circuit goes negative.

On the other hand, when the first potential line is connected to the ungrounded potential line of the AC power supply and the second potential line is connected to the grounded potential line of the AC power supply, the second potential line is held at the ground potential. In the positive half-cycles of the alternating voltage of the AC power supply, the potential on the first potential line goes positive. Then the first unidirectional conducting function element turns off and the second unidirectional conducting function element turns on, and the potential at the positive potential terminal of the negative potential generating circuit almost becomes the ground potential. In the negative half-cycles of the alternating voltage of the AC power supply, the potential on the first potential line goes negative. Then the first unidirectional conducting function element turns on and the second unidirectional conducting function element turns off, and the potential at the positive potential terminal of the negative potential generating circuit goes negative.

This way, regardless of whether the first and second potential lines are connected to either of the grounded potential line and the ungrounded potential line of the AC power supply, the first and second unidirectional conducting function elements electronically detect a potential line on the ground potential or negative potential side and the positive potential terminal of the negative potential generating circuit is automatically connected to the potential line on the ground potential or negative potential side. In this case, detecting and connecting the potential line on the ground potential or negative potential side through on/off of the first and second unidirectional conducting function elements eliminates the possibility of erroneous detection and erroneous connection. Accordingly, it is possible to automatically switch and connect the positive potential terminal of the negative potential generating circuit certainly to a potential line on the ground potential or negative potential side of the AC power supply for each positive and negative half-cycle of the alternating voltage with a simple structure.

Each of the first and second unidirectional conducting function elements may be composed of a diode. In this case a potential line on the ground potential or negative potential side is electronically detected by the two diodes and the positive potential terminal of the negative potential generating circuit is automatically switched and connected to the potential line on the ground potential or negative potential side. Hence, the structure of the positive potential terminal connecting circuit is further simplified and the positive potential terminal connecting circuit can be downsized.

These and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
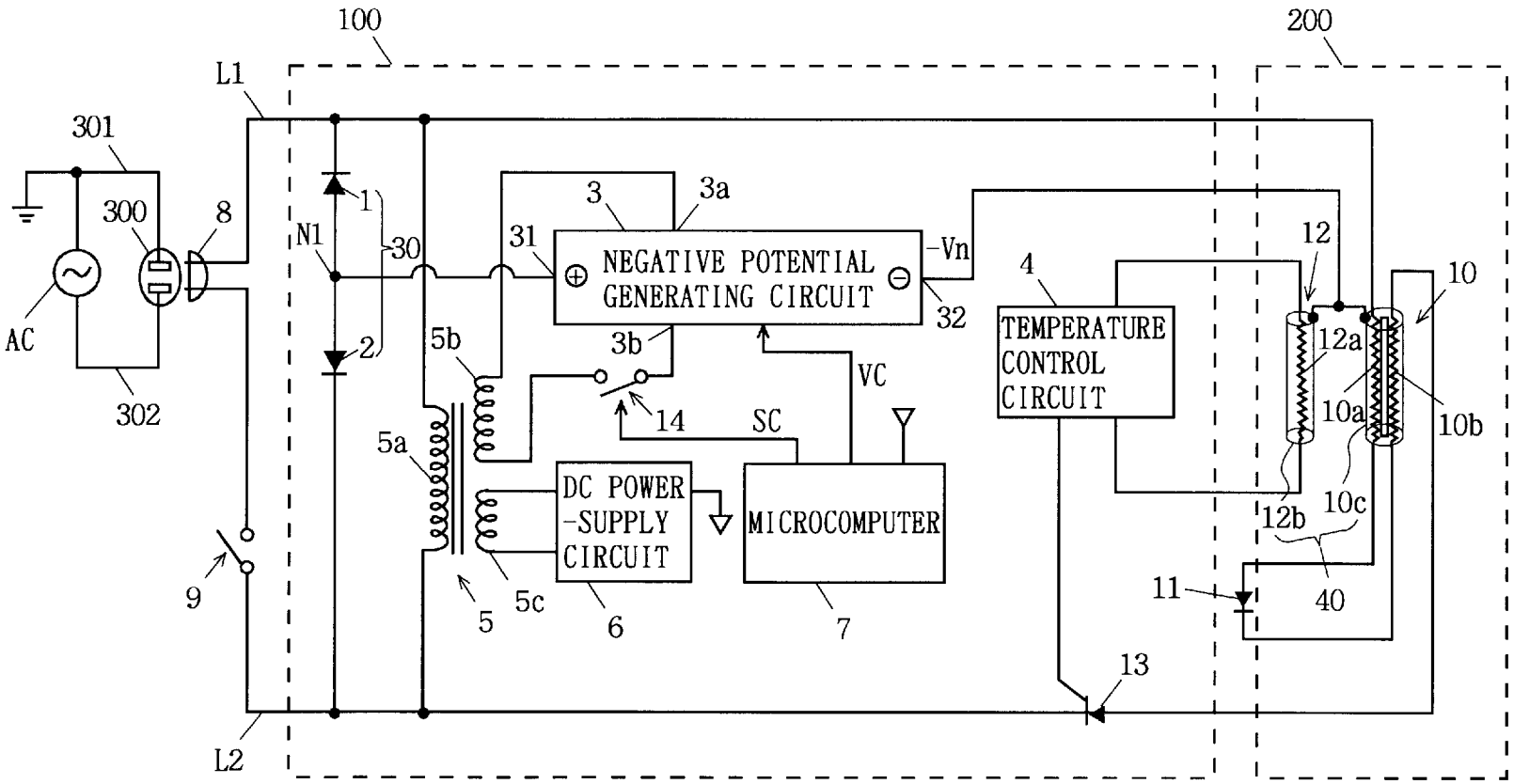
FIG. 1 is a circuit diagram of a heating appliance according to an embodiment of the present invention.

FIG. 1 is a circuit diagram of a heating appliance according an embodiment of the present invention. This heating appliance is an electric blanket, an electric rug, or a foot heater, for example. The heating appliance of FIG. 1 includes a controller portion 100 and a heating appliance body 200.

The heating appliance body 200 includes a heater 10 and a temperature sensor 12 built therein. The heater 10 includes a first heat-generating conductor 10*a*, a second heat-generating conductor 10*b* and a shield conductor 10*c*. The temperature sensor 12 includes a thermosensitive line 12*a* and a shield conductor 12*b*. In this embodiment, the shield conductor 10*c* of the heater 10 and the shield conductor 12*b* of the temperature sensor 12 are used as an electrical heating wire mat 40 for providing a negative potential.

The controller portion 100 mainly includes diodes 1 and 2, a negative potential generating circuit 3, a temperature control circuit 4, a transformer 5, a DC power-supply circuit 6, a microcomputer 7, a main switch 9, a thyristor 13 and a switching element 14.

The line L1 is connected to one electrode of a plug 8 and the line L2 is connected to the other electrode of the plug 8 through the main switch 9. The diode 1 has its anode connected to a node N1 and its cathode connected to the line L1. The diode 2 has its anode connected to the node N1 and its cathode connected to the line L2. These diodes 1 and 2 form a positive potential terminal connecting circuit 30.

The primary winding 5*a* of the transformer 5 is connected between the lines L1 and L2. The negative potential generating circuit 3 has its one power-supply terminal 3*a* connected to one end of one secondary winding 5*b* of the transformer 5, and its other power-supply terminal 3*b* connected to the other end of the secondary winding 5*b* through the switching element 14. The positive potential terminal 31 of the negative potential generating circuit 3 is connected to the node N1 and its negative potential terminal 32 is connected to the shield conductor 10*c* of the heater 10 and the shield conductor 12*b* of the temperature sensor 12. For instance, this negative potential generating circuit 3 is composed of a full wave four stage voltage multiplier rectification circuit, which outputs a negative potential of −600 V from the negative potential terminal 32, for example.

This negative potential generating circuit 3 has a built-in switching circuit for switching the level of the negative potential generated.

The DC power-supply circuit 6 is connected to the other secondary winding 5*c* of the transformer 5. The microcomputer 7 provides a control signal SC for controlling the timing of generating the negative potential and the period of the generation to the switching element 14 according to a control program and a negative potential generating pattern which are preset and also provides a control signal VC for switching the level of the negative potential to the negative potential generating circuit 3. A direct voltage for operation of the microcomputer 7 is provided by the DC power-supply circuit 6.

A diode 11 is connected between one end of the first heat-generating conductor 10*a* of the heater 10 and one end of its second heat-generating conductor 10*b*. The other end of the first heat-generating conductor 10*a* is connected to the line L1 and the other end of the second heat-generating conductor 10*b* is connected to the line L2 through the thyristor 13. The both ends of the thermosensitive line 12*a* of the temperature sensor 12 are connected to the temperature control circuit 4. The temperature control circuit 4 on/off controls the thyristor 13 on the basis of the value of the current flowing in the thermosensitive line 12*a*.

One electrode of the outlet 300 is connected to the grounded potential line (inactive potential line) 301 of the AC power supply (commercial power supplying source) AC and its other electrode is connected to the ungrounded potential line (active potential line) 302 of the AC power supply AC.

When the plug 8 is inserted into the outlet 300 and the main switch 9 is turned on, then a current flows from the line L1 to the line L2 through the first heat-generating conductor 10*a* of the heater 10, the diode 11, the second heat-generating conductor 10*b* and the thyristor 13. This causes the first and second heat-generating conductors 10*a*, 10*b* of the heater 10 to generate heat. At this time, the temperature control circuit 4 on/off controls the thyristor 13 on the basis of the value of the current flowing through the thermosensitive line 12*a* of the temperature sensor 12 to control the temperature.

The potential at the node N1 is held at the ground potential or a negative potential by the diodes 1 and 2. When the microcomputer 7 turns on the switching element 14 with the control signal SC, then a negative potential is generated from the negative potential terminal 32 of the negative potential generating circuit 3. This negative potential is applied to the shield conductor 10*c* of the heater 10 and the shield conductor 12*b* of the temperature sensor 12 serving as the electrical heating wire mat 40. This achieves the negative potential treatment function. The level of the negative potential generated from the negative potential generating circuit 3 is switched by the control signal VC of the microcomputer 7.

Figure 2A:
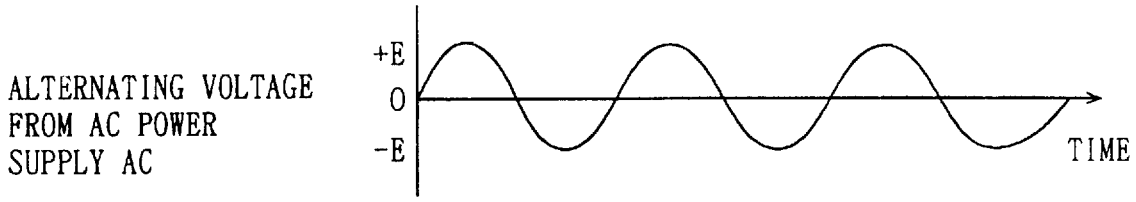
FIG. 2 is a waveform diagram of the alternating voltage of the AC power supply and a potential at the electrical heating wire mat.
Figure 2B:
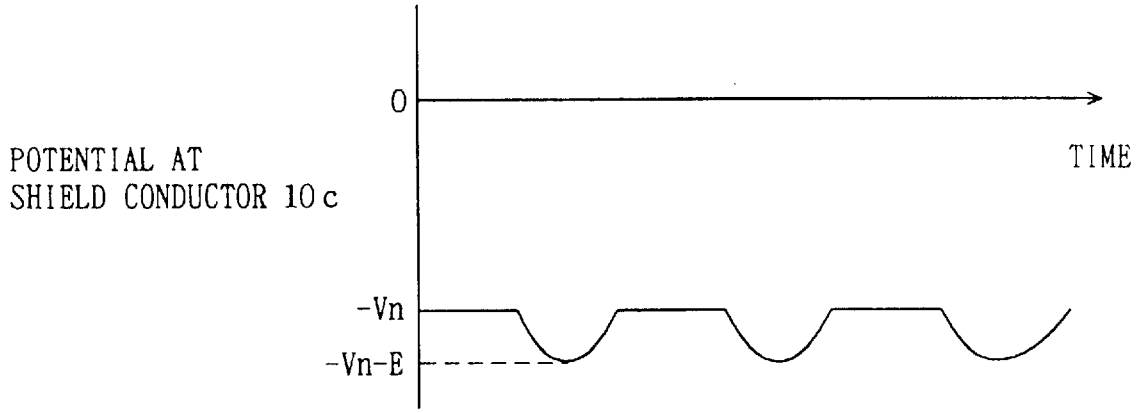

FIG. 2(*a*) is a waveform diagram of the alternating voltage of the AC power supply AC and (b) is a waveform diagram of the potential at the electrical heating wire mat 40. As shown in FIG. 2(*a*), the alternating voltage of the AC power supply AC varies in a sinusoidal manner between +E and −E. As shown in FIG. 2(*b*), the potential at the electrical heating wire mat 40 is −Vn in the positive half-cycles of the alternating voltage and it reaches −Vn−E in its negative half-cycles.

Figure 3:
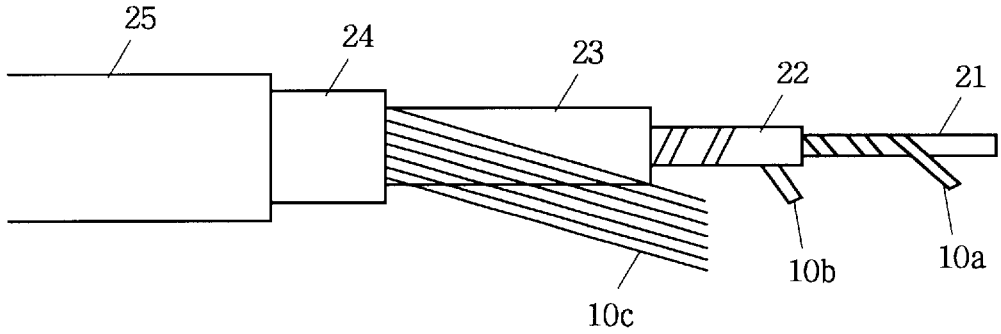
FIG. 3 is a schematic diagram showing the structure of the heater used in the heating appliance of FIG. 1.

FIG. 3 is a schematic diagram showing the structure of the heater 10 shown in FIG. 1.

In FIG. 3, the first heat-generating conductor 10*a* formed of conductive foil or parallel flat wire is spirally wound around a core material 21 composed of an insulator and the surface of the core material 21 and the first heat-generating conductor 10*a* is covered with an insulating layer 22 composed of resin. The second heat-generating conductor 10*b* composed of conductive foil or parallel flat wire is spirally wound around the insulating layer 22 and the surface of the insulating layer 22 and the second heat-generating conductor 10*b* is covered with an insulating layer 23 composed of resin. In turn, the shield conductor 10*c* is spirally wound around the insulating layer 23 and the surface of the insulating layer 23 and the shield conductor 10*c* is covered with an insulating layer 24 composed of resin. A thermally welded layer 25 is formed around the insulating layer 24.

Next, the operation of the heater 10 of the heating appliance of this embodiment will now be described referring to FIG. 4.

Figure 4:
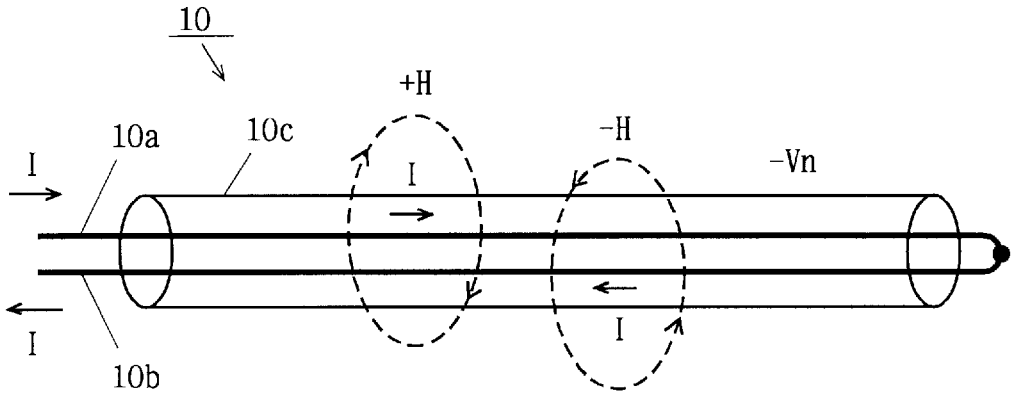
FIG. 4 is a diagram for illustrating the operation of the heater of FIG. 3.

As shown in FIG. 4, one end of the first heat-generating conductor 10*a* and one end of the second heat-generating conductor 10*b* are electrically connected to each other. When a current I is applied from the end of the first heat-generating conductor 10*a*, the current I flows in the first heat-generating conductor 10*a* and the second heat-generating conductor 10*b* in opposite directions.

This produces a magnetic field +H around the first heat-generating conductor 10*a* and a magnetic field −H around the second heat-generating conductor 10*b*. The directions of the magnetic field +H and the magnetic field −H are opposite to each other. Hence, the magnetic field +H and the magnetic field −H are cancelled and almost no magnetic field is produced around the heater 10.

The first heat-generating conductor 10*a* and the second heat-generating conductor 10*b* are integrally covered with the shield conductor 10*c* and the shield conductor 10*c* is held at the negative potential −Vn. Accordingly, the electric field in the heater 10 is intercepted by the shield conductor 10*c* and no electric field is produced outside of the heater 10.

This way, magnetic field and electric field are hardly formed outside of the heater 10 and almost no electromagnetic wave is produced. The negative potential −Vn applied to the shield conductor 10*c* effects a negative potential treatment function. Furthermore, since the shield conductor 10*c* is electrically separated from the first and second heat-generating conductors 10*a* and 10*b*, the negative potential treatment can be effected in arbitrary timing independently of the heating.

In the heater 10 of this embodiment, the first heat-generating conductor 10*a*, the second heat-generating conductor 10*b* and the shield conductor 10*c* formed on the common axis can be easily handled.

This way, the heating appliance of this embodiment realizes the negative potential treatment function without generating electro-magnetic wave from the heater 10 almost at all.

Although the first heat-generating conductor 10*a* and the second heat-generating conductor 10*b* are coaxially arranged in this embodiment, the first heat-generating conductor 10*a* and the second heat-generating conductor 10*b* may be arranged in parallel along each other.

Although the first and second heat-generating conductors 10*a* and 10*b* are used as the first and second conductive lines in the above-described embodiment, one of the first and second conductive lines may be formed of a heat-generating conductor with the other formed of a mere conductor.

Next, referring to FIGS. 5A and 5B and FIGS. 6A and 6B, the operation of the positive potential terminal connecting circuit 30 of FIG. 1 will now be described. The built-in voltages (forward internal voltage) of the diodes 1 and 2 are neglected herein. It is assumed that the negative potential generating circuit 3 generates the negative potential −Vn from the negative potential terminal 32 with the positive potential terminal 31 held at the ground potential. The character E represents amplitude of the alternating voltage.

Figure 5A:
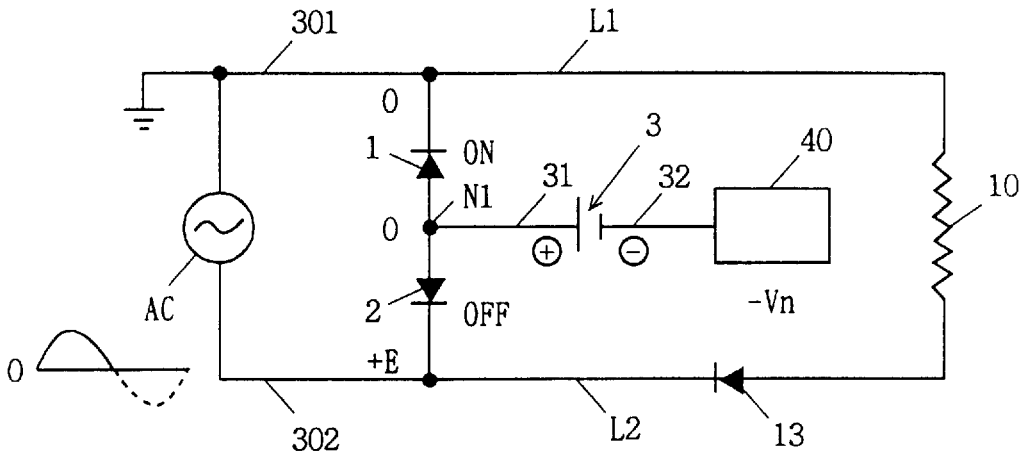
FIGS. 5A and 5B are equivalent circuit diagrams for describing the operation of the positive potential terminal connecting circuit of the heating appliance of FIG. 1.
Figure 5B:
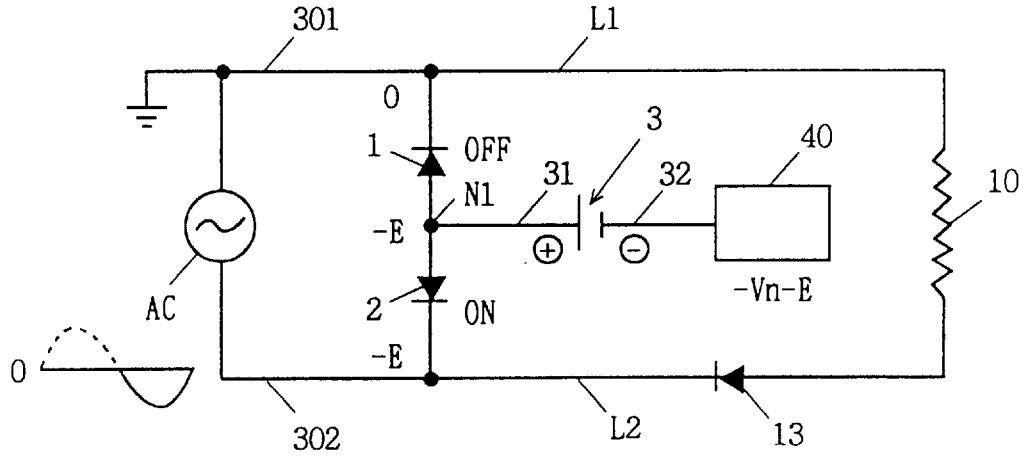

FIG. 5A and FIG. 5B are equivalent circuit diagrams in the case where the line L1 is connected to the grounded potential line 301 of the AC power supply AC and the line L2 is connected to its ungrounded potential line 302.

As shown in FIG. 5A, in the positive half-cycle of the alternating voltage, the potential on the line L1 is held at 0V and the potential on the line L2 is +E. This turns on the diode 1 and turns off the diode 2, and then the potential at the node N1 is 0V. Accordingly, the potential at the positive potential terminal 31 of the negative potential generating circuit 3 is 0V and the potential at its negative potential terminal 32 is −Vn.

As shown in FIG. 5B, in the negative half-cycle of the alternating voltage, the potential on the line L1 is held at 0V and the potential on the line L2 is −E. Then the diode 1 turns off and the diode 2 turns on, and the potential at the node N1 is −E. Hence, the potential at the positive potential terminal 31 of the negative potential generating circuit 3 reaches −E and the potential at the negative potential terminal 32 reaches −Vn−E.

Figure 6A:
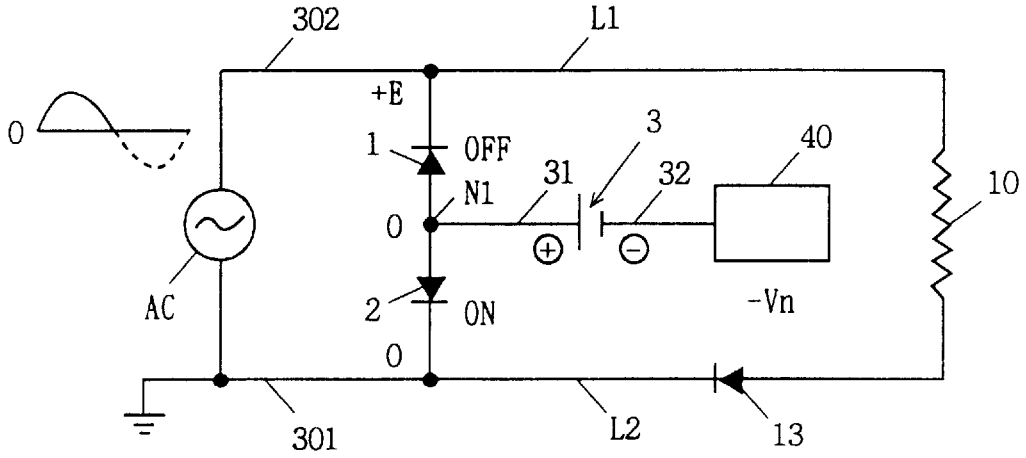
FIGS. 6A and 6B are equivalent circuit diagrams for describing the operation of the positive potential terminal connecting circuit of the heating appliance of FIG. 1.
Figure 6B:
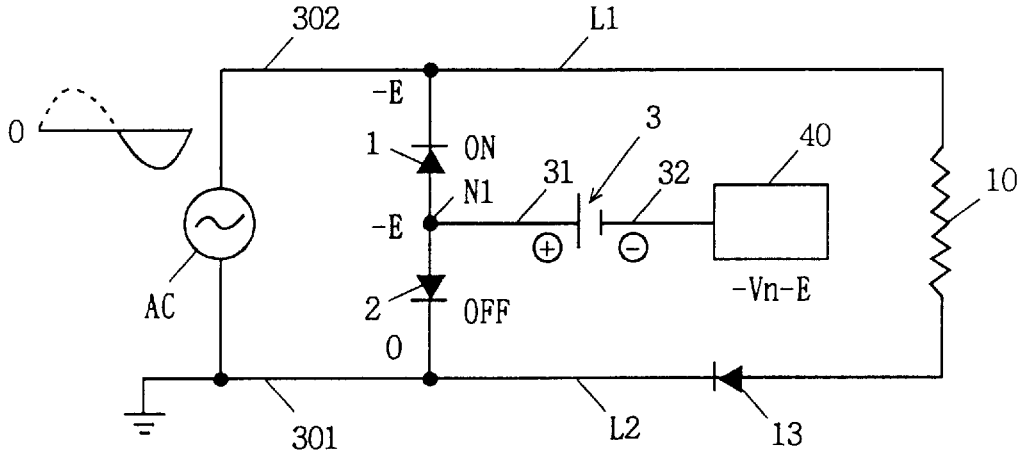

FIGS. 6A and 6B are equivalent circuit diagrams in the case where the line L1 is connected to the ungrounded potential line 302 of the AC power supply AC and the line L2 is connected to its grounded potential line 301.

As shown in FIG. 6A, in the positive half-cycle of the alternating voltage, the potential on the line L1 is +E and the potential on the line L2 is held at 0V. Then the diode 1 turns off and the diode 2 turns on, and then the potential at the node N1 is 0V. Accordingly, the potential at the positive potential terminal 31 of the negative potential generating circuit 3 is 0V and the potential at its negative potential terminal 32 is −Vn.

As shown in FIG. 6B, in the negative half-cycle of the alternating voltage, the potential on the line L1 is −E and the potential on the line L2 is held at 0V. Then the diode 1 turns on and the diode 2 turns off, and the potential at the node N1 becomes −E. Hence, the potential at the positive potential terminal 31 of the negative potential generating circuit 3 becomes −E and the potential at the negative potential terminal 32 becomes −Vn−E.

As explained above, regardless of whether the line L1 is connected to the ungrounded potential line 302 or to the grounded potential line 301, a potential line on the ground potential or negative potential side is electronically detected by the diodes 1, 2 and the positive potential terminal 31 of the negative potential generating circuit 3 is automatically connected to the potential line on the ground potential or negative potential side.

In this way, as shown in FIG. 2(*b*), the potential at the electrical heating wire mat 40 is −Vn in the positive half-cycles of the alternating voltage and it reaches −Vn−E in the negative half-cycles.

As has been described above, in the heating appliance of this embodiment, the positive potential terminal connecting circuit 30 for automatically connecting the positive potential terminal 31 of the negative potential generating circuit 3 to a potential line on the ground potential or the negative potential side is composed of the two diodes 1 and 2, which realizes an effective negative potential treatment function with simple circuit structure and at low cost.

Although the diodes are used as the unidirectional conducting function elements in the above-described embodiment, other semiconductor elements such as transistors, thyristors, etc. may be used in place of the diodes. The unidirectional conducting function element includes a bidirectional conducting element used as a unidirectional conducting element.

The positive potential terminal connecting circuit of the present invention can be applied not only to a heating appliance having a negative potential treatment function, but it can be applied also to other various kinds of electronic equipments to connect a positive potential terminal of a negative potential generating circuit to a potential line on the ground potential or negative potential side.

Figure 7:
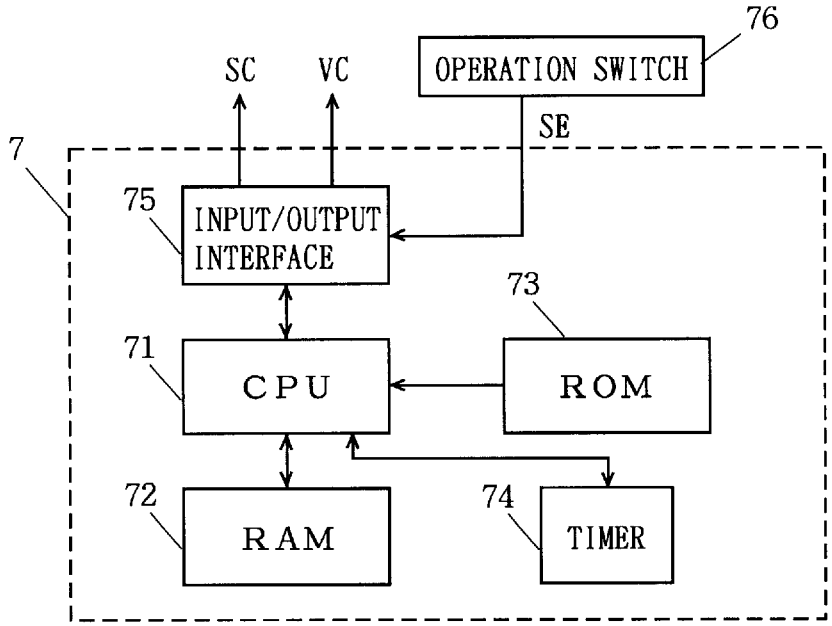
FIG. 7 is a block diagram showing the structure of the microcomputer in the heating appliance of FIG. 1.

FIG. 7 is a block diagram showing the structure of the microcomputer 7. As shown in FIG. 7, the microcomputer 7 includes a CPU (Central Processing Unit) 71, a RAM (Random Access Memory) 72, a ROM (Read Only Memory) 73, a timer 74 and an input/output interface 75.

The ROM 73 stores control program and also stores a plurality of negative potential generating patterns including generating timings and generating periods (control on the time base) of the negative potential from the negative potential generating circuit 3 and levels of the negative potential (control on the amplitude base). The RAM 72 is used as a temporary data storage area and work area. The CPU 71 is supplied with a selection signal SE from an operation switch 76 through the input/output interface 75. The CPU 71 operates according to the control program stored in the ROM 73 to select one of the negative potential generating patterns from the ROM 73 on the basis of the selection signal SE provided from the operation switch 76 and output the control signal SC and the control signal VC through the input/output interface 75 on the basis of the negative potential generating pattern selected.

The negative potential generating patterns may be stored in a non-volatile memory such as an EEPROM, an IC card, etc. In this case, it is possible to add or change the negative potential generating patterns using the operation switch 76.

FIGS. 8A to 8C and FIGS. 9A to 9C are diagrams showing examples of the negative potential generating patterns.

Figure 8A:
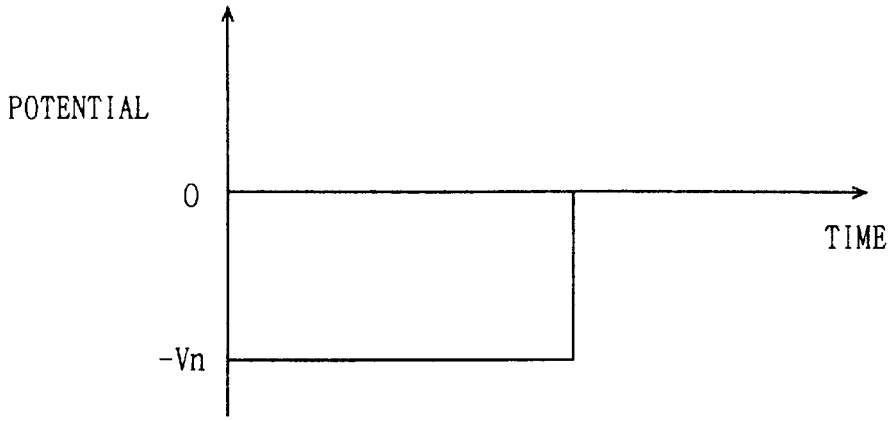
FIGS. 8A to 9C are diagrams showing examples of the negative potential generating pattern generated by the negative potential generating circuit of the heating appliance of FIG. 1.
Figure 8B:
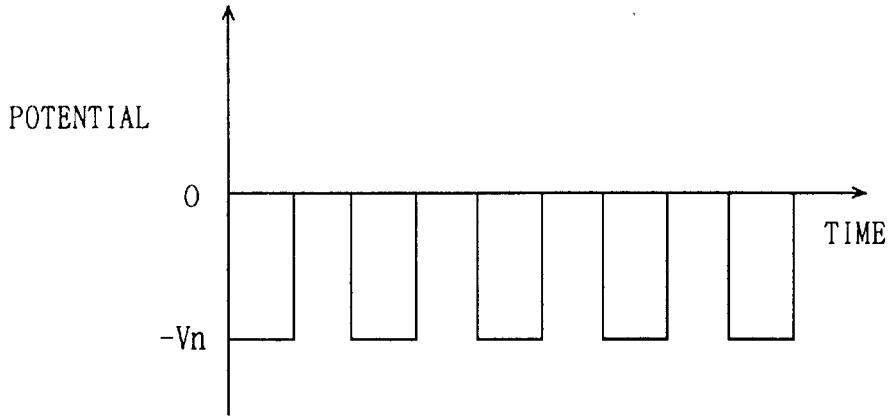
Figure 8C:
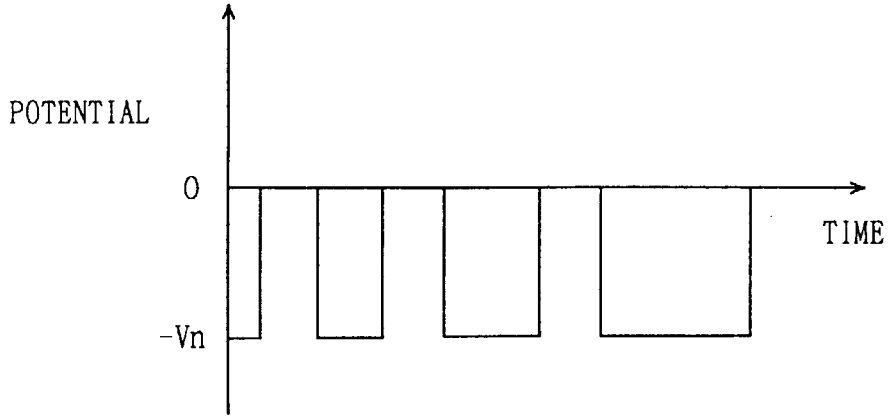

In the example of FIG. 8A, the negative potential is continuously generated at the same level in a certain period. In the example of FIG. 8B, the negative potential is intermittently generated at the same level in each of the certain periods. In the example of FIG. 8C, the negative potential is intermittently generated at the same level in different periods.

Figure 9A:
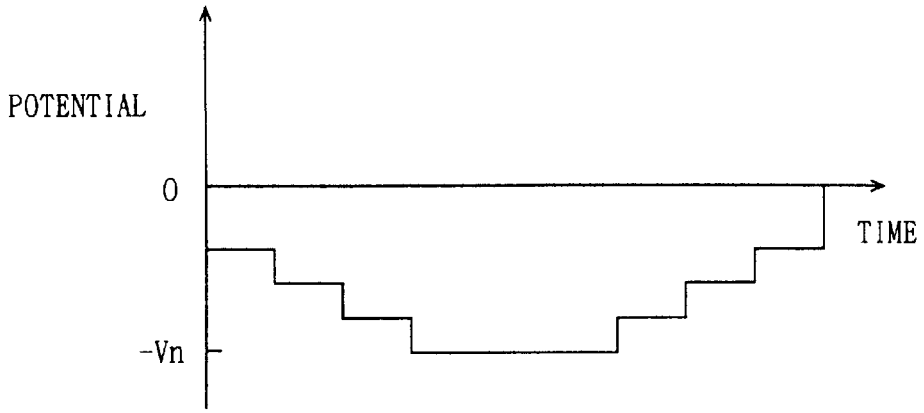
Figure 9B:
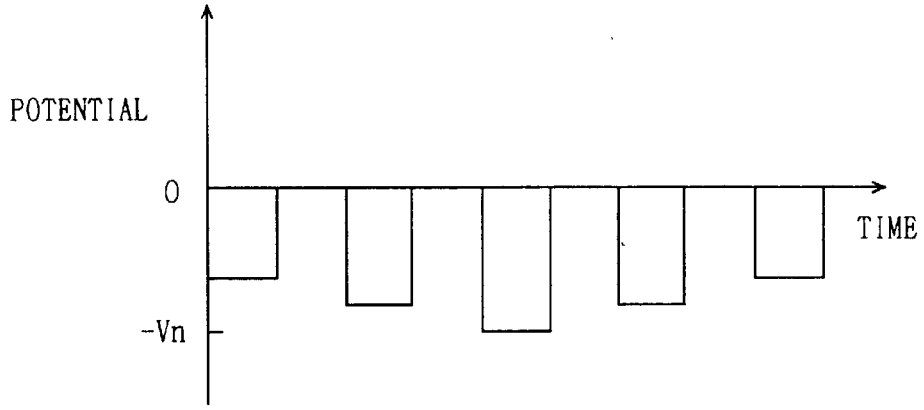
Figure 9C:
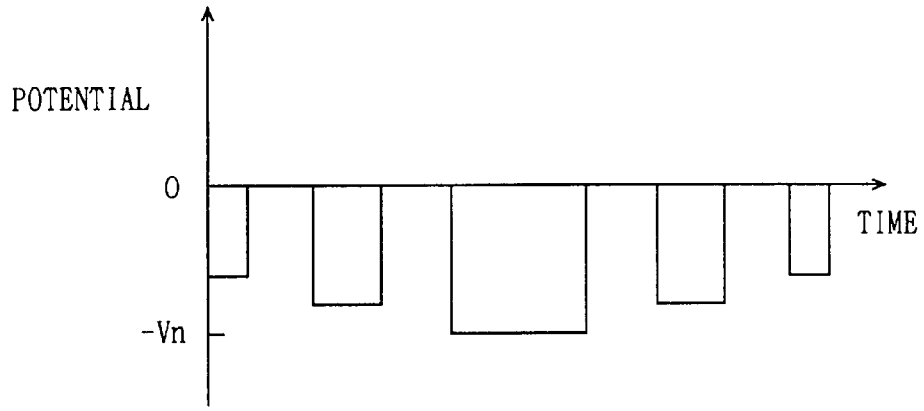
Figure 10:
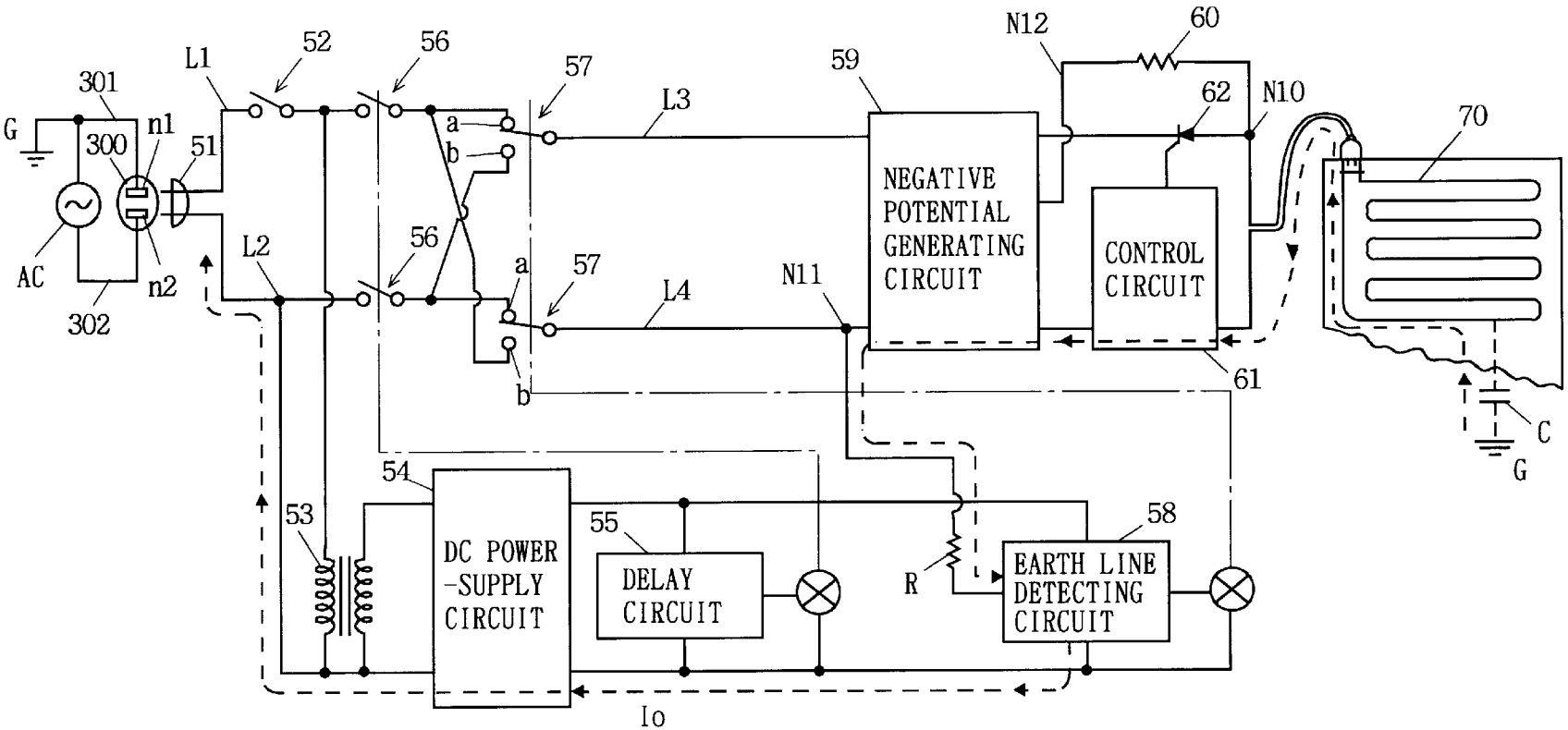
FIG. 10 PRIOR ART
FIG. 10 is a circuit diagram showing an example of a conventional heating appliance.
Figure 11:
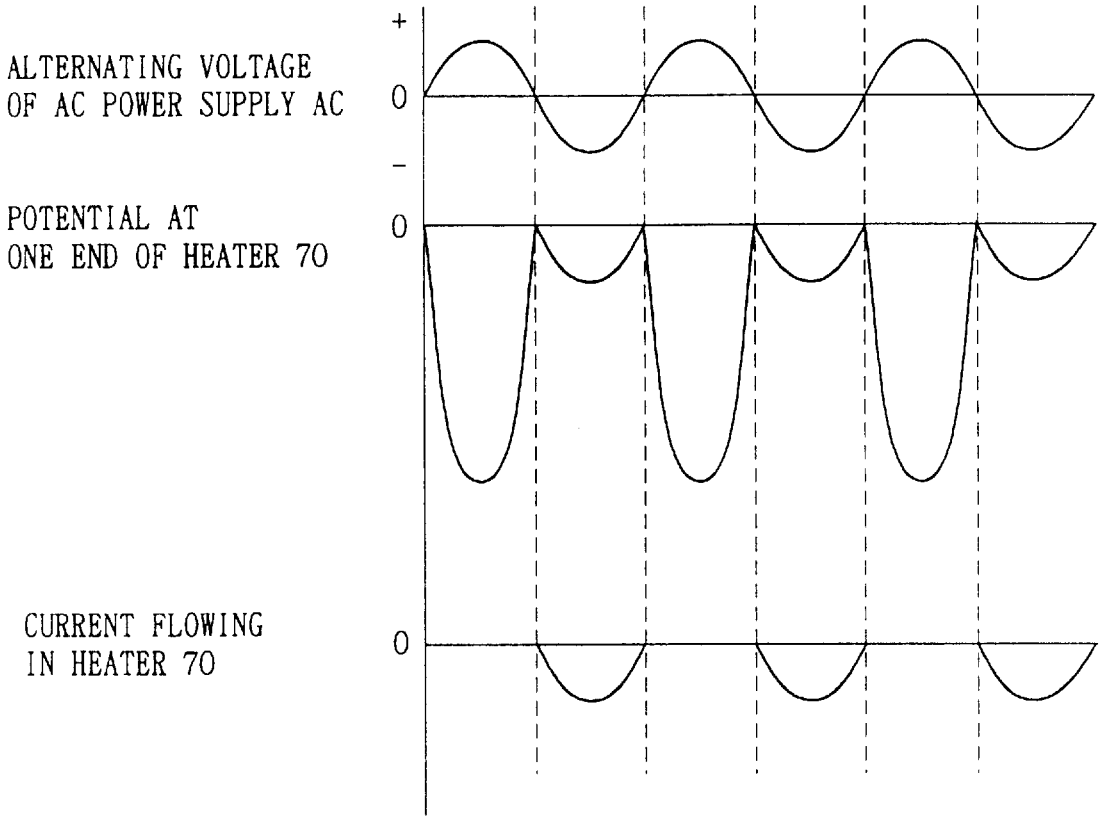
FIG. 11 PRIOR ART
FIG. 11 is a waveform diagram of the alternating voltage of the AC power supply, a potential at one end of the heater and a current flowing in the heater in the conventional heating appliance.

In the example of FIG. 9A, the negative potential is continuously generated at the different levels. In the example of FIG. 9B, the negative potential is intermittently generated at different levels in each of the certain periods. In the example of FIG. 9C, the negative potential is intermittently generated at different levels in different periods.

This way, in the heating appliance of this embodiment, it is possible to arbitrarily change the generation pattern of the negative potential generated by the negative potential generating circuit 3 through control by the microcomputer 7. This enables suitable negative potential treatment to be applied depending on condition.

Although the level of the negative potential is varied in steps in the aforementioned embodiment, the level of the negative potential may be varied continuously. The inclination of the negative potential may be varied.

While the invention has been described in detail, the foregoing description is in all aspects illustrative and not restrictive. It is understood that numerous other modifications and variations can be devised without departing from the scope of the invention.

We claim:

1. A heat appliance, comprising:

a first conductive line;

a second conductive line provided along said first conductive line;

at least one of said first and second conductive lines being composed of a heating element, one end of said first conductive line and one end of said second conductive line being electrically connected to each other;

a shield conductor integrally surrounding said first and second conductive lines;

current supplying means for supplying a current from the other end of said first conductive line to the other end of said second conductive line; and a negative potential generating circuit for holding said shield conductor at a negative potential, wherein said shield conductor is electrically insulated from said first and second conductive lines and has a current substantially equal to zero.

2. The heating appliance according to claim 1, wherein said first conductive line, said second conductive line and said shield conductor are coaxially formed.

3. The heating appliance according to claim 1, wherein said current supplying means includes an AC power supply and rectifying means for supplying a current to said first and second conductive lines only in negative half-cycles of an alternating voltage of said AC power supply.

4. The heating appliance according to claim 1, wherein said negative potential generating circuit has a positive potential terminal and a negative potential terminal and generates the negative potential from said negative potential terminal, said heating appliance further comprising, a first unidirectional conducting function element connected between said positive potential terminal of said negative potential generating circuit and a first potential line, for conducting a current in the direction from said positive potential terminal to said first potential line, a second unidirectional conducting function element connected between said positive potential terminal of said negative potential generating circuit and a second potential line, for conducting a current in the direction from said positive potential terminal to said second potential line, and connecting means for connecting said first potential line to one of a grounded potential line and an ungrounded potential line of an AC power supply and connecting said second potential line to the other of the grounded potential line and the ungrounded potential line of said AC power supply.

5. The heating appliance according to claim 4, wherein each of said first and second unidirectional conducting function elements is composed of a diode.

6. The heating appliance according to claim 1, further comprising a control circuit for controlling the pattern of generation of the negative potential generated by said negative potential generating circuit.

7. The heating appliance according to claim 6, wherein said control circuit includes, storing means for storing one or a plurality of negative potential generating patterns, selecting means for selecting any of the one or plurality of negative potential generating patterns stored in said storing means, and negative potential generating pattern control means for controlling said negative potential generating circuit on the basis of the negative potential generating pattern selected by said selecting means.

8. The heating appliance according to claim 6, wherein said negative potential generating pattern includes the generating timing and the generating period of the negative potential.

9. The heating appliance according to claim 6, wherein said negative potential generating pattern includes the level of the negative potential.

10. A heating appliance, comprising:

a negative potential generating circuit having a positive potential terminal and a negative potential terminal for generating a negative potential from said negative potential terminal;

an electrode to which the negative potential generated from said negative potential generating circuit is applied;

a first unidirectional conducting function element connected between said positive potential terminal of said negative potential generating circuit and a first potential line, for conducting a current in the direction from said positive potential terminal to said first potential line;

a second unidirectional conducting function element connected between said positive potential terminal of said negative potential generating circuit and a second potential line, for conducting a current in the direction from said positive potential terminal to said second potential line; and connecting means for connecting said first potential line to one of a grounded potential line and an ungrounded potential line of an AC power supply and connecting said second potential line to the other of the grounded potential line and the ungrounded potential line of said AC power supply.

11. The heating appliance according to claim 10, wherein each of said first and second unidirectional conducting function elements is composed of a diode.

12. A heating appliance, comprising:

a heating element;

current supplying means for supplying a current to said heating element;

a negative potential generating circuit for generating a negative potential;

an electrode provided separately from said heating element, and held at the negative potential generated by said negative potential generating circuit; and control means for controlling the generating pattern of the negative potential generated by said negative potential generating circuit, wherein said electrode is electrically insulated from said heating element and has a current substantially equal to zero.

13. The heating appliance according to claim 12, wherein said control means includes, storing means for storing one or a plurality of negative potential generating patterns, selecting means for selecting any of the one or plurality of negative potential generating patterns stored in said storing means, and negative potential generating pattern control means for controlling said negative potential generating circuit on the basis of the negative potential generating pattern selected by said selecting means.

14. The heating appliance according to claim 13, wherein said negative potential generating pattern includes the generating timing and generating period of the negative potential.

15. The heating appliance according to claim 13, wherein said negative potential generating pattern includes the level of the negative potential.

16. The heating appliance according to claim 13, wherein said heating element is composed of a heat-generating line and said electrode is composed of a shield conductor surrounding said heat-generating line.

17. A positive potential terminal connecting circuit for connecting a positive potential terminal of a negative potential generating circuit to a potential line on the ground potential or negative potential side of an AC power supply, comprising:

a first unidirectional conducting function element connected between a first potential line connected to one of the grounded potential line and the ungrounded potential line of said AC power supply and said positive potential terminal of said negative potential generating circuit, for conducting a current in the direction from said positive potential terminal to said first potential line; and a second unidirectional conducting function element connected between a second potential line connected to the other of the grounded potential line and the ungrounded potential line of said AC power supply and said positive potential terminal of said negative potential generating circuit, for conducting a current in the direction from said positive potential terminal to said second potential line.

18. The positive potential terminal connecting circuit according to claim 17, wherein each of said first and second unidirectional conducting function elements is composed of a diode.

19. A heating appliance, comprising:

a first conductive line;

a second conductive line provided along said first conductive line;

at least one of said first and second conductive lines being composed of a heating element, one end of said first conductive line and one end of said second conductive line being electrically connected to each other;

a shield conductor integrally surrounding said first and second conductive lines and held at a negative potential; and current supplying means for supplying a current from the other end of said first conductive line to the other end of said second conductive line;

wherein said shield conductor is electrically insulated from said first and second conductive lines and has a current substantially equal to zero.

* * * * *